US009168751B2

(12) United States Patent
Uchiyama

(10) Patent No.: US 9,168,751 B2
(45) Date of Patent: Oct. 27, 2015

(54) LIQUID EJECTING APPARATUS

(71) Applicant: SEIKO EPSON CORPORATION, Tokyo (JP)

(72) Inventor: Masaki Uchiyama, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/482,669

(22) Filed: Sep. 10, 2014

(65) Prior Publication Data

US 2015/0097882 A1 Apr. 9, 2015

(30) Foreign Application Priority Data

Oct. 4, 2013 (JP) ..... 2013-209113

(51) Int. Cl.
*B41J 2/175* (2006.01)
*B41J 2/165* (2006.01)

(52) U.S. Cl.
CPC . *B41J 2/165* (2013.01); *B41J 2/175* (2013.01)

(58) Field of Classification Search
CPC ..... B41J 2/175; B41J 2/17566; B41J 2/165
USPC ..... 347/6
See application file for complete search history.

(56) References Cited

U.S. PATENT DOCUMENTS

| | | | | |
|---|---|---|---|---|
| 6,786,566 | B2 * | 9/2004 | Shindo | 347/30 |
| 2002/0089555 | A1 | 7/2002 | Kobayashi et al. | |
| 2011/0205292 | A1 * | 8/2011 | Kneezel et al. | 347/29 |

FOREIGN PATENT DOCUMENTS

| | | |
|---|---|---|
| JP | 09-169118 | 6/1997 |
| JP | 2001-322290 | 11/2001 |
| JP | 2002-052731 | 2/2002 |
| JP | 2002-273906 | 9/2002 |

* cited by examiner

*Primary Examiner* — Alessandro Amari
*Assistant Examiner* — Michael Konczal
(74) *Attorney, Agent, or Firm* — Workman Nydegger

(57) ABSTRACT

Provided is a liquid ejecting apparatus which includes a plurality of liquid receiving portions in which the same kinds of liquid are received, a switching unit which switches the liquid receiving portion that supplies the liquid to a liquid ejecting head, and a controller which performs a maintenance process including discharging the liquid through the liquid ejecting head, in which, when a liquid residual amount of the liquid receiving portion that supplies the liquid to the ejecting head, which is calculated by a residual amount estimation portion, is less than a determination value, the controller performs the maintenance process in a state where the liquid receiving portion to supply the liquid to the liquid ejecting head is selected among the plurality of liquid receiving portions and the liquid is supplied from the selected liquid receiving portion to the liquid ejecting head.

9 Claims, 4 Drawing Sheets

LIQUID EJECTING APPARATUS

BACKGROUND

1. Technical Field

The present invention relates to a liquid ejecting apparatus, such as an ink jet type printer.

2. Related Art

An ink jet type printer which can estimate a residual amount of ink (liquid) in an ink cartridge as an example of a liquid receiving portion has been known as one type of a liquid ejecting apparatus (for example, see JP-A-9-169118).

In the ink jet type printer described above, ink consumption amounts which are obtained based on, for example, amounts of the ink ejected through a liquid ejecting head during a printing operation (a liquid ejection operation) performed on a paper sheet as an example of a printing target are integrated. In a case where an ink receiving amount of the ink cartridge, in a state where the ink cartridge is fully filled with ink, is set to an ink total amount, when an ink residual amount estimation value, which is a difference obtained by subtracting the ink consumption amounts from the ink total amount is calculated, if this ink residual amount estimation value is less than a predetermined ink-empty determination value, it is determined that the ink cartridge is in a so-called ink empty state, that is, a state where a very small amount of ink remains in the ink cartridge.

However, in the ink jet type printer described above, a maintenance process, such as a cleaning operation in which the thickened ink is forcibly discharged, along with, for example, air bubbles, through nozzles formed on the liquid ejecting head, is performed. Even in the maintenance process described above, the ink in the ink cartridge is consumed. Therefore, when the ink residual amount estimation value is smaller than a determination value which is set in accordance with the ink consumption amounts by which the ink can be consumed in the maintenance process, the maintenance process is prevented from being performed because there is a possibility that the ink in the ink cartridge may be exhausted during the maintenance process.

Both an actual amount of the ink ejected through the nozzles of the liquid ejecting head during a printing operation and an actual amount of the ink discharged through the liquid ejecting head during the maintenance process vary in accordance with individual differences caused during manufacturing, by usage environment, or the like. Therefore, the ink consumption amount calculated by internal processing of the ink jet type printer is generally set to a value which is set in the assumption that an individual difference and usage environment are in a condition where the actual ink consumption amount is the maximum.

Accordingly, in some cases, the ink residual amount estimation value which is obtained based on the ink consumption amount calculated by internal processing is smaller than the actual ink residual amount of the ink cartridge. In this case, when the ink residual amount estimation value is less than the determination value described above, it is estimated that the ink residual amount is small, though the amount of the ink remaining in the ink cartridge is actually adequate for performing the maintenance process. As a result, the maintenance process is prevented from being performed.

This problem is not limited to an ink jet type printer but is generally common to a liquid ejecting apparatus capable of ejecting liquid supplied from a liquid receiving portion in which the liquid is received.

SUMMARY

An advantage of some aspects of the invention is to provide a liquid ejecting apparatus in which, even when it is estimated that a liquid residual amount of a liquid supply portion is small, an opportunity to perform a maintenance process including discharging liquid through a liquid ejecting head can be increased.

Hereinafter, means of the invention and operational effects thereof will be described.

According to an aspect of the invention, there is provided a liquid ejecting apparatus which can eject liquid supplied from a plurality of liquid receiving portions in which the same kinds of the liquid are received and which includes a switching unit which switches the liquid receiving portion that supplies the liquid to a liquid ejecting head ejecting the liquid, a residual amount estimation portion which separately estimates liquid residual amounts of the respective liquid receiving portions by integrating liquid consumption amounts by the liquid ejecting head, and a controller which performs a maintenance process including discharging the liquid through the liquid ejecting head, in which, in a case where, among the liquid receiving portions, the liquid receiving portion which supplies the liquid to the liquid ejecting head is set to one liquid receiving portion, when a liquid residual amount of the one liquid receiving portion, which is calculated by the residual amount estimation portion, is less than a determination value, the controller performs the maintenance process in a state where the liquid receiving portion to supply the liquid to the liquid ejecting head is selected among the plurality of liquid receiving portions and the liquid is supplied from the selected liquid receiving portion to the liquid ejecting head.

In a case where the determination value is set in accordance with a predicted value of the amount of the liquid discharged through the liquid ejecting head during the maintenance process to be performed, when the liquid residual amount of one liquid receiving portion, which is calculated by the residual amount estimation portion, is less than the determination value, it is estimated that the liquid residual amount of the one liquid receiving portion is small. In this configuration, when it is estimated that the liquid residual amount of the one liquid receiving portion is small as described above, the maintenance process is performed in a state where a liquid receiving portion to supply the liquid to the liquid ejecting head is selected among the plurality of liquid receiving portions including the one liquid receiving portion and the liquid is supplied from the selected liquid receiving portion to the liquid ejecting head. In other words, the maintenance process is performed in a state where the liquid is supplied, to the liquid ejecting head, from at least one liquid receiving portion among the liquid receiving portions. Accordingly, even when it is estimated that the liquid residual amount of one liquid supply portion is small, it is possible to increase the opportunity to perform the maintenance process.

In the liquid ejecting apparatus, it is preferable that, when the liquid residual amount of the one liquid receiving portion, which is calculated by the residual amount estimation portion, is less than the determination value, the controller start the maintenance process with maintaining a state where the one liquid receiving portion is selected among the liquid receiving portions and the liquid is supplied from the one liquid receiving portion to the liquid ejecting head.

In some cases, the liquid residual amount of the one liquid receiving portion, which is calculated by the residual amount estimation portion, is smaller than the actual liquid residual amount. In this case, there is a possibility that the liquid residual amount of the one liquid receiving portion, which is calculated by the residual amount estimation portion, may be less than the determination value described above, though the actual liquid residual amount of the one liquid receiving portion is equal to or greater than the determination value. In this case, it is possible to appropriately perform the maintenance process even with maintaining a state where the liquid is supplied from the one liquid receiving portion to the liquid ejecting head. Here, in the configuration described above, even when the liquid residual amount of the one liquid receiving portion, which is calculated by the residual amount estimation portion, is less than the determination value, the maintenance process is started with maintaining a state where the liquid is supplied from the one liquid receiving portion to the liquid ejecting head. Accordingly, when the actual liquid residual amount of the one liquid receiving portion is equal to or greater than the determination value described above, it is possible to finish the maintenance process before the liquid in the one liquid receiving portion is actually exhausted. In other words, it is possible to appropriately perform the maintenance process with effectively using the liquid received in the one liquid receiving portion.

The liquid ejecting apparatus may further include a sensing device which senses presence or absence of the liquid remaining in the liquid receiving portion. In addition, it is preferable that, when the sensing device senses that the liquid remaining in the one liquid receiving portion is exhausted during the maintenance process performed in a state where the liquid is supplied from the one liquid receiving portion to the liquid ejecting head, the controller perform the maintenance process in a state where the switching unit is controlled such that the liquid is supplied, to the liquid ejecting head, from the other liquid receiving portion, aside from the one liquid receiving portion.

In some cases, the liquid residual amount of the one liquid receiving portion, which is calculated by the residual amount estimation portion, is approximately the same as the actual liquid residual amount thereof. In this case, when the liquid residual amount of the one liquid receiving portion, which is calculated by the residual amount estimation portion, is less than the determination value described above, the actual liquid residual amount of the one liquid receiving portion may be smaller than the determination value. In a state where the actual liquid residual amount is less than the determination value, as described above, when the maintenance process is started with maintaining a state where the liquid is supplied from the one liquid receiving portion to the liquid ejecting head, the liquid remaining in the one liquid receiving portion may be exhausted during the maintenance process. Here, in the configuration described above, when the sensing device senses that the liquid remaining in the one liquid receiving portion is exhausted, during the maintenance process performed with maintaining a state where the liquid is supplied from the one liquid receiving portion to the liquid ejecting head, the maintenance process is performed after the liquid supply state is changed to a state where the liquid is supplied from the other liquid receiving portion to the liquid ejecting head. In other words, it is possible to appropriately perform the maintenance process in such a manner that the liquid receiving portion to supply the liquid to the liquid ejecting head is changed during the maintenance process.

In the liquid ejecting apparatus, it is preferable that, when the liquid residual amount of the one liquid receiving portion, which is calculated by the residual amount estimation portion, is less than the determination value, the controller perform the maintenance process in which an amount of the liquid discharged through the liquid ejecting head is smaller than that in a case where the liquid residual amount of the one liquid receiving portion, which is calculated by the residual amount estimation portion, is equal to or greater than the determination value.

According to the configuration described above, when it is estimated that the liquid residual amount of the one liquid receiving portion is small, the maintenance process in which the amount of the liquid discharged through the liquid ejecting head is small is performed. Therefore, it is possible to increase a possibility that the maintenance process may be finished without changing the liquid receiving portion to supply the liquid to the liquid ejecting head, from the one liquid receiving portion to the other liquid receiving portion.

In the liquid ejecting apparatus, it is preferable that, when the liquid residual amount of the one liquid receiving portion, which is calculated by the residual amount estimation portion, is less than the determination value, the controller perform the maintenance process in a state where the switching unit is controlled such that the other liquid receiving portion, aside from the one liquid receiving portion, is selected among the liquid receiving portions and the liquid is supplied from the other liquid receiving portion to the liquid ejecting head.

According to the configuration described above, when the liquid residual amount of the one liquid receiving portion, which is calculated by the residual amount estimation portion, is less than the determination value, the maintenance process is performed in a state where the liquid is supplied from the other liquid receiving portion to the liquid ejecting head. Therefore, even when it is estimated that the liquid residual amount of the one liquid receiving portion is small, it is possible to appropriately perform the maintenance process, using the other liquid receiving portion in which the same kind of liquid as that in the one liquid receiving portion is received.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Hereinafter, Embodiment 1 in which a liquid ejecting apparatus is embodied in an ink jet type printer will be described with reference to the accompanying drawings.

Figure 1:
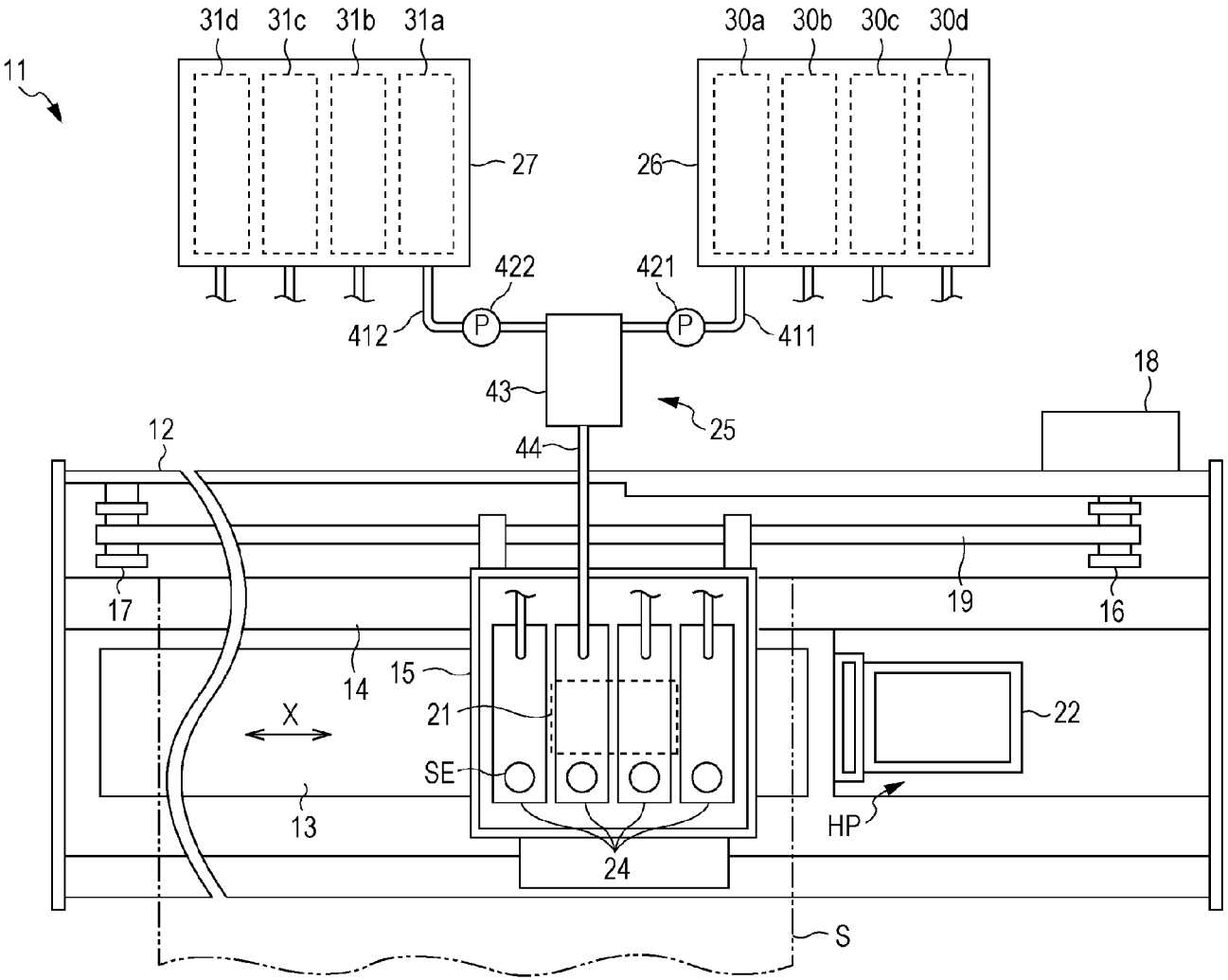
FIG. 1 is a view illustrating a schematic configuration of Embodiment 1 of a liquid ejecting apparatus.

An ink jet type printer 11 includes a main body case 12 having a substantially rectangular box shape, as illustrated in FIG. 1. A support member 13 which supports a print target (a liquid ejection target), such as a paper sheet S, is provided on a front side of a lower portion of an inner portion of the main body case 12, in a state where the support member 13 extends in a longitudinal direction (a right-left direction in FIG. 1) of the main body case 12, that is, a main scanning direction X.

In the inner portion of the main body case 12, a guide shaft 14 extending in the main scanning direction X is provided on an upper side of a rear portion of the support member 13. The guide shaft 14 supports a carriage 15 which reciprocates in the main scanning direction X. In a rear side surface of the inner portion of the main body case 12, a driving pulley 16 is rotationally supported in a position which corresponds to one end (a right end in FIG. 1) of both ends of the guide shaft 14 and a driven pulley 17 is rotationally supported in a position which corresponds to the other end (a left end in FIG. 1). A carriage motor 18 is connected to the driving pulley 16. In addition, an endless timing belt 19 is wound around a pair of pulleys 16 and 17. The carriage 15 reciprocates in the main scanning direction X in such a manner that a driving force from the carriage motor 18 is transmitted to the carriage 15 through the timing belt 19.

A liquid ejecting head 21 having a plurality of nozzles through which the ink as an example of liquid is ejected is provided on a lower surface side of the carriage 15. Furthermore, a home position HP which is a retreat position of the liquid ejecting head 21 is provided in a movement range of the carriage 15 in the main scanning direction X. A maintenance unit 22 for performing various maintenance processes is provided on a lower side of the home position HP.

Figure 2:
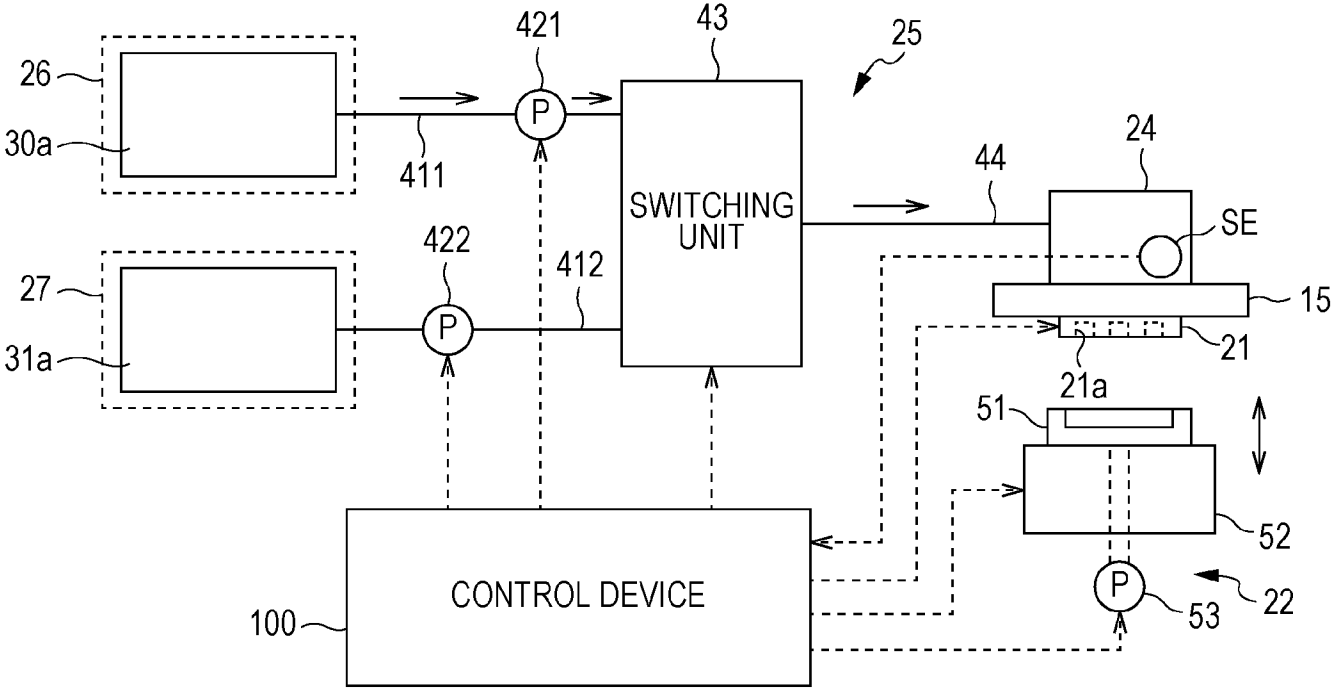
FIG. 2 is a schematic view illustrating a supply path and a control configuration of ink.

At least one (four in this embodiment) valve unit 24 for temporarily storing the ink is provided in the carriage 15, as illustrated in FIGS. 1 and 2. The ink received in ink cartridges 30*a* to 30*d* and 31*a* to 31*d* which are mounted in the ink jet type printer 11 and functions as an example of a liquid receiving portion is supplied to the valve unit 24 through an ink supply device 25. Then, the ink is supplied from the valve unit 24 to nozzles 21*a* of the liquid ejecting head 21.

A detection sensor SE which detects an ink storage amount, that is, an amount of ink temporarily stored in the valve unit 24, is provided in the valve unit 24. The detection sensor SE outputs, to a control device 100, a detection signal corresponding to the detected ink storage amount. Examples of the detection sensor SE described above include a detection sensor in which a floating member of which the position varies in accordance with an ink amount in the valve unit 24 is provided and which outputs the detection signal corresponding to the position of the floating member.

At least one (two in this embodiment) of cartridge holders 26 and 27 is provided in the ink jet type printer 11 of this embodiment. At least one (four in this embodiment) of the ink cartridges 30*a* to 30*d* and one (four in this embodiment) of the ink cartridges 31*a* to 31*d* are attachably/detachably mounted in the cartridge holders 26 and 27.

The ink cartridge 30*a* in which a first ink is received, the ink cartridge 30*b* in which a second ink is received, the ink cartridge 30*c* in which a third ink is received, and the ink cartridge 30*d* in which a fourth ink is received are mounted in the first cartridge holder 26. The ink cartridge 31*a* in which the first ink is received, the ink cartridge 31*b* in which the second ink is received, the ink cartridge 31*c* in which the third ink is received, and the ink cartridge 31*d* in which the fourth ink is received are mounted in the second cartridge holder 27.

The first ink in the ink cartridges 30*a* and 31*a* is supplied to the valve unit 24 for the first ink, through the ink supply device 25 for the first ink. The second ink in the ink cartridges 30*b* and 31*b* is supplied to the valve unit 24 for the second ink, through the ink supply device 25 for the second ink. The third ink in the ink cartridges 30*c* and 31*c* is supplied to the valve unit 24 for the third ink, through the ink supply device 25 for the third ink. The fourth ink in the ink cartridges 30*d* and 31*d* is supplied to the valve unit 24 for the fourth ink, through the ink supply device 25 for the fourth ink.

Next, the ink supply device 25 will be described with reference to FIGS. 1 and 2. In FIGS. 1 and 2, only the ink supply device 25 for the first ink which supplies the first ink to the valve unit 24 is illustrated and other ink supply devices 25 are not illustrated. The illustration and the configuration of other ink supply devices for other inks will not be repeated because the configurations thereof are the same as that of the ink supply device 25 for the first ink.

The ink supply device 25 for the first ink includes a first connection flow path 411 connected to the ink cartridge 30*a* in the first cartridge holder 26 and a second connection flow path 412 connected to the ink cartridge 31*a* in the second cartridge holder 27, as illustrated in FIGS. 1 and 2. Supply pumps 421 and 422 are provided in the first and second connection flow paths 411 and 412 such that the supply pumps 421 and 422 suck up the first ink from the ink cartridges 30*a* and 31*a* and discharge the first ink to a downstream side, that is, the valve unit 24 side.

A switching unit 43 is connected to downstream ends of the first and second connection flow paths 411 and 412 and the switching unit 43 is connected to the valve unit 24 through the confluent flow path 44. When the first ink is supplied from the ink cartridge 30*a* to the valve unit 24, the switching unit 43 is operated to connect the first connection flow path 411 and the confluent flow path 44. When the first ink is supplied from the ink cartridge 31*a* to the valve unit 24, the switching unit 43 is operated to connect the second connection flow path 412 and the confluent flow path 44. In addition, when the first connection flow path 411 is connected to the confluent flow path 44 through the switching unit 43, the ink cartridge 30*a* corresponds to "one liquid receiving portion" which supplies the first ink to the liquid ejecting head 21 and the ink cartridge 31*a* corresponds to "the other liquid receiving portion" in which the same kind of ink (the same kind of liquid) as the ink in the one liquid receiving portion is received. On the contrary, when the second connection flow path 412 is connected to the confluent flow path 44 through the switching unit 43, the ink cartridge 31*a* corresponds to "one liquid receiving portion" and the ink cartridge 30*a* corresponds to "the other liquid receiving portion". In this specification, an ink cartridge which supplies the ink to the valve unit 24 and corresponds to "one liquid receiving portion" is, in some cases, referred to as a "supply cartridge".

Here, an example of an operation of the ink supply device 25 in a case where the ink cartridge 30*a* is a supply cartridge will be described. In this case, the supply pump 421 provided in the first connection flow path 411 is driven such that the ink storage amount which is detected by the detection sensor SE provided in the valve unit 24 for the first ink is set to be within a specified storage amount range. In other words, when the ink storage amount is less than the lower limit value of the specified storage amount range, the first ink received in the ink cartridge 30*a* is supplied to the valve unit 24, by the operation of the supply pump 421.

In this case, when a very small amount of the first ink remains in the ink cartridge 30*a*, the first ink is not supplied to the valve unit 24 even when the supply pump 421 is driven. In a case where, even when the supply pump 421 is driven, the ink storage amount in the valve unit 24, which is detected by the detection sensor SE, does not increase, the control device 100 can determine that a very small amount of the first ink remains in the ink cartridge 30*a*. Therefore, an example of a "sensing device" for sensing the presence or absence of the ink remaining in the ink cartridge is constituted by the detection sensor SE and the control device 100.

Next, the maintenance unit 22 will be described with reference to FIG. 2.

The maintenance unit 22 includes a cap 51, as illustrated in FIG. 2. When the liquid ejecting head 21 is positioned in the home position HP, the cap 51 abuts on the liquid ejecting head 21 so as to cover the nozzles 21*a*. Furthermore, a movement mechanism 52 and a suction pump 53 which sucks remains in the cap 51 are provided in the maintenance unit 22. The movement mechanism 52 moves the cap 51 between a capping position in which the cap 51 abuts on the liquid ejecting head 21 and the retreat position (a position illustrated in FIG. 2) separated from the liquid ejecting head 21.

When the suction pump 53 is driven in a state where the cap 51 abuts on the liquid ejecting head 21, a cleaning process in which the ink is discharged to the cap 51 through the nozzles 21*a* is performed. At this time, a certain amount of the ink, which corresponds to a driving aspect of the suction pump 53, is discharged, along with a thickened ink, air bubbles, and the like, through the liquid ejecting head 21. From this point, the cleaning process corresponds to an example of the "maintenance process" in which the ink is discharged through the liquid ejecting head 21.

In the ink jet type printer 11, various types of the cleaning processes in which the driving aspects of the suction pump 53 are different from each other are prepared in advance. In a state where intensity of a generated suction force (a negative pressure) is constant, when a so-called strong cleaning process in which a drive time of the suction pump 53 is long is performed an amount of the ink discharged through the liquid ejecting head 21 is large. When a so-called weak cleaning process in which a drive time of the suction pump 53 is shorter than that of the strong cleaning process, an amount of the ink discharged through the liquid ejecting head 21 is smaller than that of the strong cleaning process.

In the ink jet type printer 11 of this embodiment, when an elapsed time from the latest cleaning process is equal to or longer than a predetermined time or when a user performs an operation requiring the cleaning process, it is determined that a condition for performing the cleaning process is satisfied. As a result, the cleaning process is performed.

Next, various processes by the control device 100 will be described.

First, a process for estimating the ink residual amount of the ink cartridge will be described.

The control device 100 calculates an ink consumption amount of each of the ink cartridges 30*a* to 30*d* and 31*a* to 31*d*. When the ink cartridge 30*a* is a supply cartridge, for example, the control device 100 counts the number of ejection times N, that is, the number of times in which the first ink is ejected through the nozzles 21*a* for the first ink during a printing operation (a liquid ejecting operation). In addition, the control device 100 counts the number of operation times of the cleaning process, that is, the number of operation times of strong cleaning process M1 and the number of operation times of weak cleaning process M2. The control device 100 calculates an ink consumption amount Q by the liquid ejecting head 21, using a relational expression (Expression 1) illustrated below. "A" in the relational expression (the Expression 1) is a value corresponding to one ink ejecting amount through the nozzles 21*a*. "A×N" is an integrated value of the ink ejection amounts through the nozzles 21*a*. In addition, "B1" is a predicted value of an amount of one ink (for example, the first ink) discharged in accordance with the strong cleaning process. "B2" is a predicted value of an amount of one ink (for example, the first ink) discharged in accordance with the weak cleaning process. In other words, "B1×M1" is an integrated value of the ink discharge amounts due to the strong cleaning process and "B2×M2" is an integrated value of the ink discharge amounts due to the weak cleaning process.

$$Q=A\times N+B1\times M1+B2\times M2 \quad \text{(Expression 1)}$$

When the ink receiving amount of the ink cartridge in a state where the ink cartridge is fully filled with ink is set to an ink total amount "Rmax", the control device 100 calculates an ink residual amount estimation value "R", that is, an estimation value of the ink residual amount of the ink cartridge at the moment, using a relational expression (Expression 2) illustrated below. In other words, the control device 100 integrates the ink consumption amounts (=A×N) by the liquid ejecting head 21, and thus the control device 100 constitutes an example of a "residual amount estimation portion" for separately estimating the ink residual amounts of the respective ink cartridges 30*a* to 30*d* and 31*a* to 31*d*.

$$R=R\max-Q \quad \text{(Expression 2)}$$

The "A", "B1", and "B2" are set in advance in the assumption that an individual difference and usage environment are in a condition where the actual ink consumption amount is the maximum within the permissible range. Accordingly, although, there is a possibility that the calculated ink residual amount estimation value R may be less than the actual ink residual amount, there is almost no possibility that the calculated ink residual amount estimation value R may be greater than the actual ink residual amount.

Next, a processing routine by the control device 100 when an operation condition of the strong cleaning process is satisfied will be described with reference to a flowchart illustrated in FIG. 3.

Figure 3:
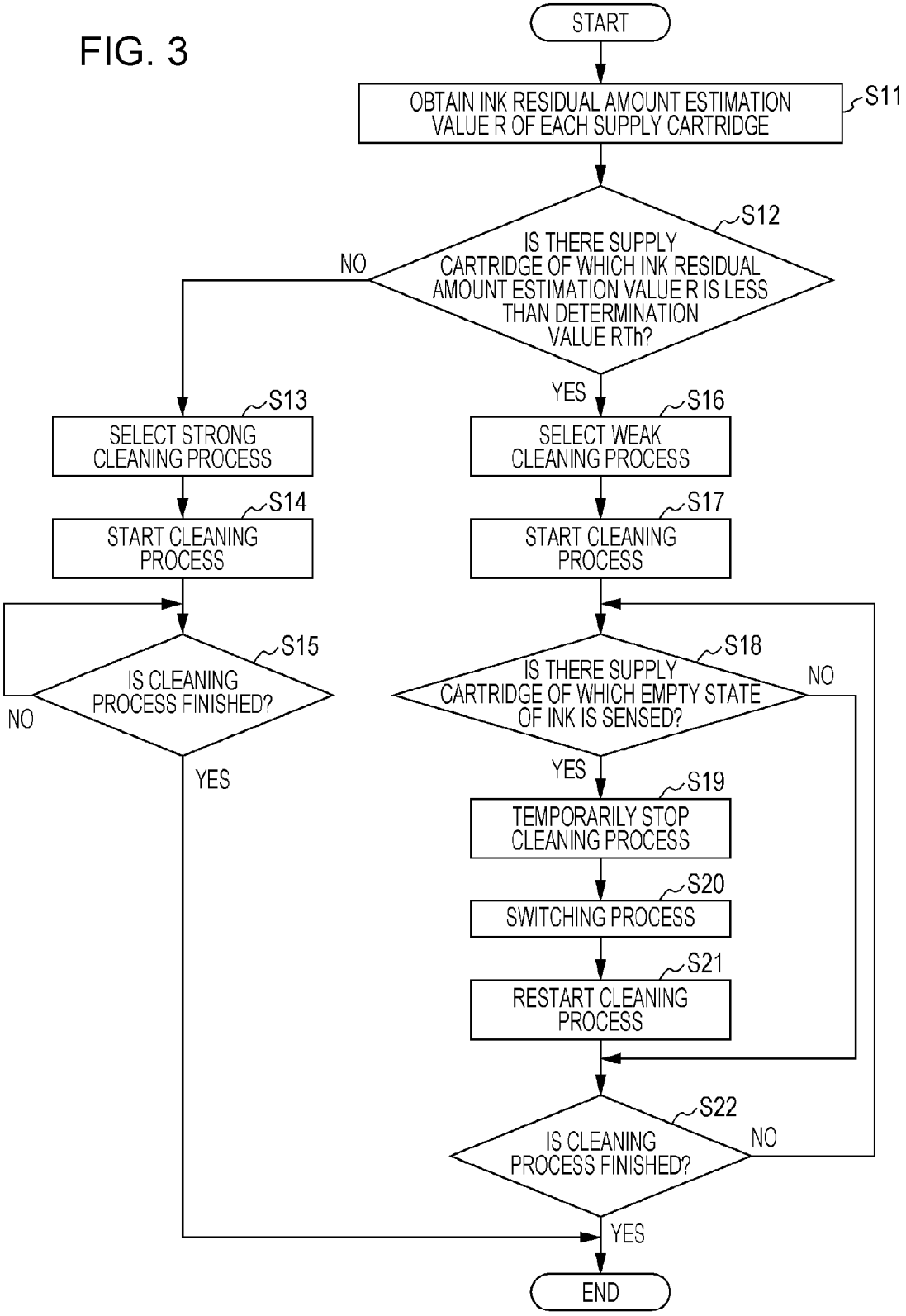
FIG. 3 is a flowchart illustrating a processing routine when a cleaning process of the Embodiment 1 is performed.

In this processing routine, the control device 100 obtains the ink residual amount estimation value R of each supply cartridge, as illustrated in FIG. 3 (Step S11). Then, the control device 100 determines whether or not the supply cartridge of which the ink residual amount estimation value R is less than a determination value RTh is present in the supply cartridges (Step S12). This determination value RTh is set to a value which is the same as the discharge amount B2 or is slightly larger than the discharge amount B2 of one of the inks, which is performed in accordance with the strong cleaning process.

When there is no supply cartridge of which the ink residual amount estimation value R is less than the determination value RTh, it can be determined that there is no supply cartridge of which the ink residual amount becomes "0 (zero)" during the strong cleaning process. Therefore, when there is no supply cartridge of which the ink residual amount estimation value R becomes a value less than the determination value RTh (Step S12:NO), the control device 100 selects the strong cleaning process as a cleaning process to be performed (Step S13), and then starts the strong cleaning process (Step S14). Then, the control device 100 determines whether or not the strong cleaning process is finished (Step S15). When the strong cleaning process is still on operation (Step S15:NO), the control device 100 performs a determination process of the Step S15 until the strong cleaning process is finished. However, when the strong cleaning process is finished (Step S15:YES), the control device 100 finishes this processing routine. From this point, the control device 100 of the ink jet type printer 11 of this embodiment also functions as a "controller" for performing the cleaning process.

Meanwhile, when there is a supply cartridge of which the ink residual amount estimation value R becomes a value less than the determination value RTh, there is a possibility that the ink residual amount of the supply cartridge may become "0 (zero)" during the cleaning process. Therefore, when there is a supply cartridge of which the ink residual amount estimation value R becomes a value less than the determination value RTh (Step S12:YES), the control device 100 selects the weak cleaning process as a cleaning process to be performed (Step S16), and then starts the weak cleaning process (Step S17). In other words, in the ink jet type printer 11 of this embodiment, when there is a supply cartridge of which the ink residual amount estimation value R becomes a value less than the determination value RTh, the control device 100 selects the supply cartridge and starts the cleaning process, using the supply cartridge.

Subsequently, the control device 100 determines whether or not there is a supply cartridge of which an empty state of the ink is sensed, that is, a supply cartridge of which the ink residual amount becomes almost "0 (zero)" (Step S18). When there is no supply cartridge of which the empty state of the ink is sensed (Step S18:NO), the control device 100 causes the process to proceed to Step S22 described below.

Meanwhile, when there is a supply cartridge of which the empty state of the ink is sensed (Step S18:YES), the control device 100 temporarily stops the weak cleaning process (Step S19). Then, the control device 100 performs a switching process for switching the supply cartridge (Step S20). When the sensing device senses the empty state of the ink in the ink cartridge 30*a* which supplies the first ink, the control device 100 controls the switching unit 43 such that the first ink supply cartridge is switched from the ink cartridge 30*a* (one liquid receiving portion) to the ink cartridge 31*a* (the other liquid receiving portion). Next, the control device 100 restarts the weak cleaning process (Step S21), and then the process proceeds to the subsequent Step S22.

In the Step S22, the 100 determines whether or not the weak cleaning process is finished. When the weak cleaning process is still on operation (Step S22:NO), the control device 100 causes the process to proceed to the Step S18 described above. On the contrary, when the weak cleaning process is finished (Step S22:YES), the control device 100 finishes this processing routine.

Next, an operation when the cleaning process is performed will be described. In this case, it is assumed that the ink residual amount estimation value R of the ink cartridge 30*a* as the first ink supply cartridge is less than the determination value RTh and the ink residual amount estimation value R of each of the other ink cartridges 30*b*, 30*c*, and 30*d* is equal to or greater than the determination value RTh. In addition, it is assumed that the ink residual amount estimation value R of the ink cartridge 31*a* in which the first ink is received is equal to or greater than the determination value RTh.

When the operation condition of the cleaning process is satisfied, the cap 51 abuts on the liquid ejecting head 21 positioned in the home position HP. In this case, the ink residual amount estimation value R of the ink cartridge 30*a* is less than the determination value RTh, and thus the weak cleaning process is started. Accordingly, the suction pump 53 is driven, and thus the ink starts to be discharged through the respective nozzles 21*a* of the liquid ejecting head 21.

In this case, when the actual ink residual amount of the ink cartridge 30*a* is sufficiently larger than the ink residual amount estimation value R and the actual ink residual amount is equal to or greater than the determination value RTh, the weak cleaning process is finished in a state where the first ink supply cartridge is not switched from the ink cartridge 30*a* to the ink cartridge 31*a*.

Meanwhile, when the actual ink residual amount of the ink cartridge 30*a* is almost the same as the ink residual amount estimation value R and the actual ink residual amount is less than the determination value RTh, it is sensed that the ink residual amount of the ink cartridge 30*a* becomes almost "0 (zero)" during the weak cleaning process. Then, the weak cleaning process is temporarily stopped and the first ink supply cartridge is switched from the ink cartridge 30*a* to the ink cartridge 31*a*. Subsequently, the weak cleaning process is restarted in this state. Next, when an operation period of the weak cleaning process elapses, the weak cleaning process is finished.

According to this embodiment described above, the following effects can be obtained.

(1) In a case where the cleaning process is performed, even when there is a supply cartridge of which the ink residual amount estimation value R is less than the determination value RTh, the cleaning process is started without changing the supply cartridge. In this case, when the actual ink residual amount of the supply cartridge of which the ink residual amount estimation value R is less than the determination value RTh is equal to or greater than the determination value RTh, the cleaning process is finished without changing the supply cartridge during the cleaning process. Therefore, even when it is estimated that the ink residual amount of the supply cartridge is small, it is possible to appropriately perform the cleaning process with effectively using the ink received in the supply cartridge. In other words, when there is a supply cartridge of which the ink residual amount estimation value R is less than the determination value RTh, it is possible to increase the opportunity to perform the cleaning process, compared to a case where the cleaning process is prevented from being performed in this condition.

(2) However, when the actual ink residual amount of the supply cartridge of which the ink residual amount estimation value R is less than the determination value RTh is less than the determination value RTh, in some cases, a state where the ink residual amount of the supply cartridge becomes "0 (zero)" is detected by the detection sensor SE, during the cleaning process. In this case, the cleaning process can be continued by switching the supply cartridge to the other ink cartridge. Accordingly, even when the cleaning process is started in a state where there is a supply cartridge of which the ink residual amount is actually small, it is possible to appropriately perform the cleaning process, using a plurality of ink cartridges in which the same kinds of ink are received.

(3) When there is no supply cartridge of which the ink residual amount estimation value R is less than the determination value RTh, the strong cleaning process is performed. When there is a supply cartridge of which the ink residual amount estimation value R is less than the determination value RTh, the weak cleaning process in which the amount of the ink discharged through the liquid ejecting head 21 is smaller than that of the strong cleaning process is performed. Therefore, when it is estimated that the ink residual amount of the supply cartridge is small, a possibility that the cleaning process is finished without changing the supply cartridge is high, compared to a case where the strong cleaning process is performed.

Embodiment 2

Next, Embodiment 2 in which a liquid ejecting apparatus is embodied in an ink jet type printer will be described with reference to the accompanying drawings. The Embodiment 2 is different from the Embodiment 1 in that the details of the process are different in a case where there is a supply cartridge of which the ink residual amount estimation value R is less than the determination value RTh. Accordingly, the following description places more focus on differences between the Embodiment 1 and Embodiment 2. In the following description, the same reference numerals are given to components having the same configuration as those in the Embodiment 1 and the description thereof will not be repeated.

A processing routine by the control device 100 when the operation condition of the cleaning process is satisfied will be described with reference to a flowchart illustrated in FIG. 4.

Figure 4:
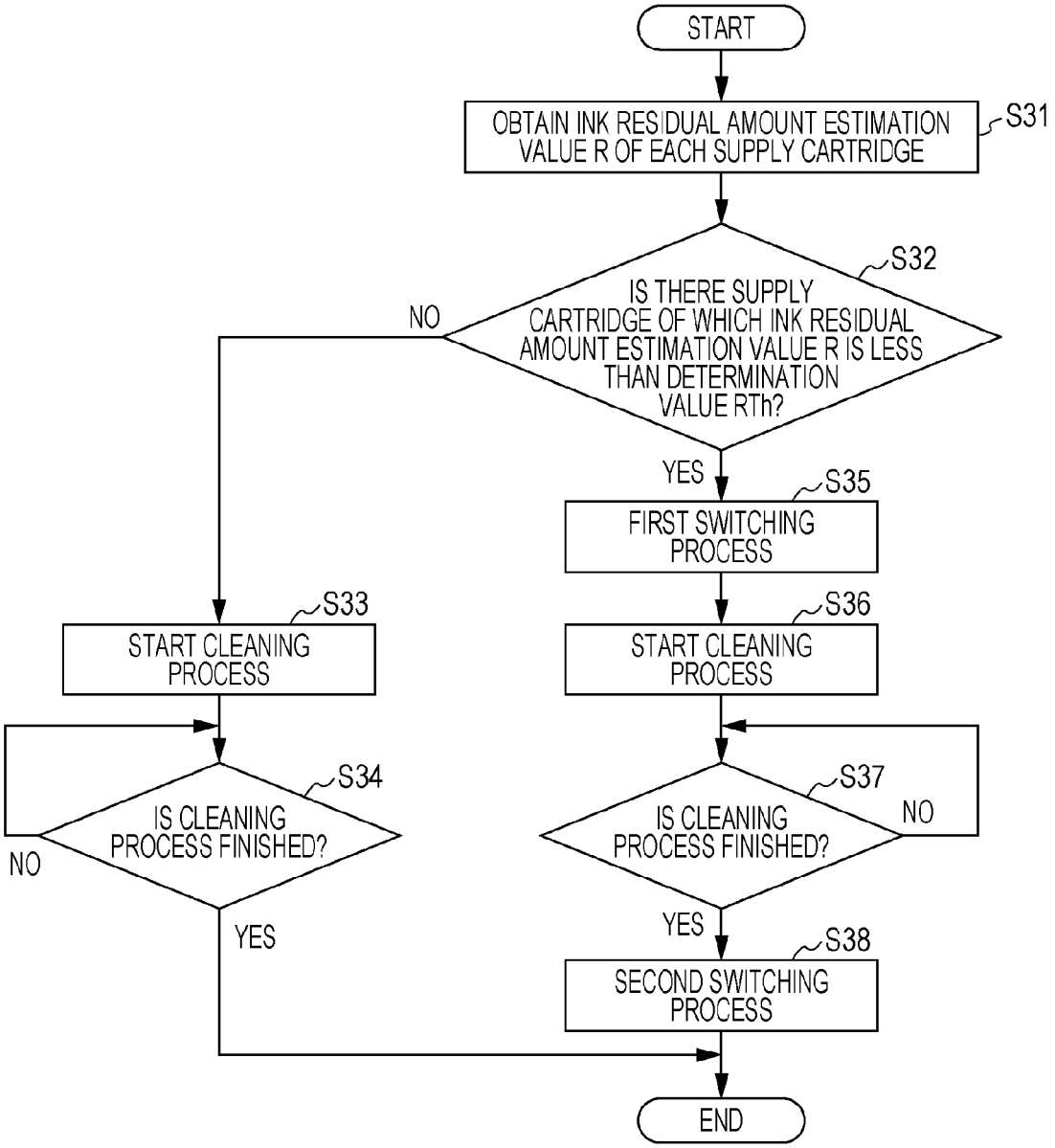
FIG. 4 is a flowchart illustrating a processing routine when a cleaning process of Embodiment 2 is performed.

In this processing routine, the control device 100 obtains the ink residual amount estimation value R of each supply cartridge, as illustrated in FIG. 4 (Step S31). Next, the control device 100 determines whether or not there is a supply cartridge of which the ink residual amount estimation value R is less than the determination value RTh, among the respective supply cartridges (Step S32). When there is no supply cartridge of which the ink residual amount estimation value R is less than the determination value RTh (Step S32:NO), the control device 100 starts the cleaning process (Step S33). Then, the control device 100 determines whether or not the cleaning process is finished (Step S34). When the cleaning process is still on operation (Step S34:NO), the control device 100 performs the determination process of the Step S34 until the cleaning process is finished. On the contrary, when the cleaning process is finished (Step S34:YES), the control device 100 finishes this processing routine.

Meanwhile, when there is a supply cartridge of which the ink residual amount estimation value R is less than the determination value RTh (Step S32:YES), the control device 100 performs a first switching process in which the supply cartridge of which the ink residual amount estimation value R is less than the determination value RTh is switched (Step S35). When ink residual amount estimation value R of the ink cartridge 30*a*, that is, a first ink supply cartridge, is less than the determination value RTh, for example, the control device 100 controls the switching unit 43 such that the first ink can be supplied from the ink cartridge 31*a* to the valve unit 24. In other words, in the ink jet type printer 11 of this embodiment, when there is a supply cartridge of which the ink residual amount estimation value R is less than the determination value RTh, the control device 100 selects the other ink cartridge in which the same kind of the ink is received and causes the cleaning process to be performed, using the other ink cartridge.

Then, the control device 100 causes the cleaning process to be started (Step S36). Subsequently, the control device 100 determines whether or not the cleaning process is finished (Step S37). When the cleaning process is still on operation (Step S37:NO), the control device 100 performs a determination process of the Step S37 until the cleaning process is finished. On the contrary, when the cleaning process is finished (Step S37:YES), the control device 100 performs a second switching process in which the supply cartridge is switched back to the cartridge used before the cleaning process is performed (Step S38). When the first ink supply cartridge is switched from, for example, the ink cartridge 30*a* to the ink cartridge 31*a* by the first switching process which is performed before the cleaning process starts, the control device 100 controls the switching unit 43 such that the first ink in the ink cartridge 30*a* is supplied to the valve unit 24 again. Then, the control device 100 finishes this processing routine.

Next, an operation when the cleaning process is performed will be described. In this case, it is assumed that the ink residual amount estimation value R of the ink cartridge 30*a* as the first ink supply cartridge is less than the determination value RTh and the ink residual amount estimation value R of each of the other ink cartridges 30*b*, 30*c*, and 30*d* is equal to or greater than the determination value RTh. In addition, it is assumed that the ink residual amount estimation value R of the ink cartridge 31*a* in which the first ink is received is equal to or greater than the determination value RTh.

The first ink supply cartridge is switched from the ink cartridge 30*a* to the ink cartridge 31*a* by the first switching process which is a process prior to the cleaning process. Accordingly, the ink residual amount estimation value R of each supply cartridge is equal to or greater than the determination value RTh. In the state described above, the cleaning process is performed. Then, when the cleaning process is finished, the first ink supply cartridge is switched from the ink cartridge 31*a* to the ink cartridge 30*a* by the second switching process. As a result, the ink in the ink cartridge 30*a* is consumed in, for example, the following printing process.

According to the embodiment described above, the following effects can be obtained.

(4) When there is a supply cartridge of which the ink residual amount estimation value R is less than the determination value RTh, the supply cartridge is switched to the other ink cartridge in which the same kind of the ink is received, and then the cleaning process is performed. In this case, the cleaning process can be finished without changing the supply cartridge during the cleaning process. Therefore, even when it is estimated that there is a supply cartridge having a small ink residual amount, it is possible to appropriately perform the cleaning process, using the other ink cartridge described above. In other words, when there is a supply cartridge of which the ink residual amount estimation value R is less than the determination value RTh, it is possible to increase the opportunity to perform the cleaning process, compared to a case where the cleaning process is prevented from being performed in this condition.

(5) When the cleaning process is performed in a state where the first switching process is performed, the supply cartridge is switched back to the cartridge used before the cleaning process is performed, by the second switching process which is performed in a state where the cleaning process is finished. Therefore, printing on the paper sheet S can be performed using the supply cartridge of which the ink residual amount estimation value R is less than the determination value RTh.

The embodiments described above can be modified as follows.

In some cases, a user using the ink jet type printer 11 may perceive degrees of a gap between the ink residual amount estimation value R and the actual ink residual amount and tendency in the degrees of the gap therebetween. In this case, even when the ink residual amount estimation value R of the ink cartridge 30*a* in which the first ink is received is less than the determination value RTh, for example, the user can appropriately determine between performing the cleaning process without changing the cartridge or performing the cleaning process with switching the first ink supply cartridge to the ink cartridge 31*a*.

Therefore, in Embodiment 1, when there is a supply cartridge of which the ink residual amount estimation value R is less than the determination value RTh, this information may be reported to a user and the user may select a next process to perform between starting the cleaning process without changing the supply cartridge and starting the cleaning process with switching the supply cartridge to the other ink cartridge in which the same kind of the ink is received. Then, the cleaning operation may be performed based on the process selected by the user.

It is assumed that the ink supply device 25 has a configuration in which the ink can be supplied to the valve unit 24, at the same time, from a plurality of ink cartridges in which the same kinds of the ink (for example, the first ink) are received. In this case, when there is a supply cartridge of which the ink residual amount estimation value R is equal to or less than the determination value RTh, the cleaning process may be performed in a state where the ink is supplied, to the valve unit 24, from two or more ink cartridges including one ink cartridge which is the supply cartridge mentioned above.

In the Embodiment 1, when there is a supply cartridge of which the ink residual amount estimation value R is equal to or less than the determination value RTh, a cleaning process may be performed in such a manner that the ink is discharged through the liquid ejecting head 21 by as much as in the case of the cleaning process when there is no supply cartridge of which the ink residual amount estimation value R is equal to or less than the determination value RTh.

In the Embodiment 1, when the empty state of the ink in the supply cartridge is sensed during the cleaning process which is started in a state where there is a supply cartridge of which the ink residual amount estimation value R is equal to or less than the determination value RTh, this information may be reported to a user. Then, the user may select a next process to perform between the cleaning process with changing the supply cartridge to the other ink cartridge installed in advance and the cleaning process in a state where the empty ink cartridge is replaced by a new ink cartridge and the new ink cartridge is set to the supply cartridge.

In each embodiment, the determination value RTh may be a value which is set in accordance with a type of the cleaning process to be performed. When the strong cleaning process is to be performed, the determination value RTh may be set to the amount "B1" of one ink discharged in accordance with the strong cleaning process or may be set to a value slightly greater than the discharge amount "B1". In addition, when the weak cleaning process is to be performed, the determination value RTh may be set to the amount "B2" of one ink discharged in accordance with the weak cleaning process or may be set to a value slightly greater than the discharge amount "B2".

A flushing operation in which the ink is ejected through the nozzles 21*a* by driving an actuator of the liquid ejecting head 21 may be performed as a maintenance process including discharging the ink through the liquid ejecting head 21. In a case where there is a strong cleaning process of which the ink residual amount estimation value R is less than determination value RTh, even when the flushing operation described above is performed, a next process may be selected between whether to perform the flushing operation without changing the supply cartridge and whether to perform the flushing operation with changing the supply cartridge to the other ink cartridge.

In each embodiment, the ink jet type printer may be a printer in which three ink cartridges or more having the same kind of the ink received therein can be mounted.

In each embodiment described above, the liquid ejecting apparatus may be a liquid ejecting apparatus that ejects or discharges a liquid aside from ink. Furthermore, the small amount of liquid discharged from the liquid ejecting apparatus includes granule forms, teardrop forms, and forms that pull trails in a string-like form therebehind. In addition, the liquid referred to here can be any material capable of being ejected by the liquid ejecting apparatus. For example, any matter can be used as long as the matter is in its liquid phase, including liquids having high or low viscosity, sol, gel water, other inorganic solvents, organic solvents, liquid solutions, liquid resins, and fluid states such as liquid metals (metallic melts). Furthermore, in addition to liquids as a single state of a matter, liquids in which the particles of a functional material composed of a solid matter such as pigments, metal particles, or the like are dissolved, dispersed, or mixed in a liquid carrier are included as well. Ink, a liquid crystal or the like is exemplified as a representative example of a liquid in the embodiments described above. In this case, the ink includes a general water-based ink and oil-based ink, aside from various liquid compositions of a gel ink, a hot melt ink or the like. A liquid ejecting apparatus which ejects liquid containing material such as an electrode material or a coloring material in a dispersed or dissolved state, which is used for manufacturing a liquid crystal display, an electroluminescence (EL) display, a surface-emitting display, a color filter or the like is exemplified as a specific example of the liquid ejecting apparatus. In addition, the liquid ejecting apparatus may be a liquid ejecting apparatus for ejecting a living organic material used for manufacturing a biochip, a liquid ejecting apparatus for ejecting a liquid as a sample used as a precision pipette, a printing equipment, a micro dispenser or the like. Further, the liquid ejecting apparatus may be a liquid ejecting apparatus for precisely ejecting lubricant to a precision machine such as a watch or a camera, or a liquid ejecting apparatus that ejects, on a substrate, a transparent resin liquid such as an ultraviolet curing resin in order to form a minute hemispherical lens (an optical lens) used in an optical communication element or the like. In addition, the liquid ejecting apparatus may be a liquid ejecting apparatus that ejects an etching liquid such as acid or alkali to etch a substrate or the like.

Next, technical ideas that can be grasped from the embodiments described above and other embodiments will be added as follows.

(A) When each of both the liquid residual amount of the one liquid receiving portion and the liquid residual amount of the other liquid receiving portion, which is calculated by the residual amount estimation portion, is less than the determination value, the controller may perform the maintenance process in a state where the switching unit is controlled such that both the one liquid receiving portion and the other liquid receiving portion are selected and the liquid is supplied, to the liquid ejecting head, from both the one liquid receiving portion and the other liquid receiving portion.

In this configuration, even when each of both the liquid residual amount in the one liquid receiving portion and the liquid residual amount in the other liquid receiving portion is small, the maintenance process is performed in a state where the liquid can be supplied, to the liquid ejecting head, from both the one liquid receiving portion and the other liquid receiving portion. In other words, even when it is estimated that the liquid residual amount of one liquid supply portion is small, it is possible to increase the opportunity to perform the maintenance process, in such a manner that two liquid receiving portions or more, including the one liquid receiving portion, is used.

The entire disclosure of Japanese Patent Application No. 2013-209113, filed Oct. 4, 2013 is expressly incorporated by reference herein.

What is claimed is:

1. A liquid ejecting apparatus which includes a liquid ejecting head ejecting liquid, the liquid being supplied from a plurality of liquid receiving portions in which the same kinds of the liquid are received through a confluent flow path, the liquid ejecting apparatus comprising:

a switching unit which switches the liquid receiving portion communicated with the confluent flow path so as to supply the liquid to the liquid ejecting head;

a residual amount estimation portion which separately estimates liquid residual amounts of the respective liquid receiving portions by integrating liquid consumption amounts by the liquid ejecting head; and a controller which performs a maintenance process including discharging the liquid through the liquid ejecting head, wherein, in a case where, among the liquid receiving portions, the liquid receiving portion which supplies the liquid to the liquid ejecting head is set to one liquid receiving portion, when a liquid residual amount of the one liquid receiving portion, which is calculated by the residual amount estimation portion, is less than a determination value, the controller performs the maintenance process in a state where the liquid receiving portion communicated with the confluent flow path is selected among the plurality of liquid receiving portions and the liquid is supplied from the selected liquid receiving portion to the liquid ejecting head.

2. The liquid ejecting apparatus according to claim 1, wherein, when the liquid residual amount of the one liquid receiving portion, which is calculated by the residual amount estimation portion, is less than the determination value, the controller starts the maintenance process with maintaining a state where the one liquid receiving portion is selected among the liquid receiving portions and the liquid is supplied from the one liquid receiving portion to the liquid ejecting head.

3. The liquid ejecting apparatus according to claim 2, further comprising:

a sensing device which senses the presence or absence of the liquid remaining in the liquid receiving portion, wherein, when the sensing device senses that the liquid remaining in the one liquid receiving portion is exhausted during the maintenance process performed in a state where the liquid is supplied from the one liquid receiving portion to the liquid ejecting head, the controller performs the maintenance process in a state where the switching unit is controlled such that the other liquid receiving portion is communicated with the confluent flow path so as to supply the liquid, to the liquid ejecting head, from the other liquid receiving portion, aside from the one liquid receiving portion.

4. The liquid ejecting apparatus according to claim 2, wherein, when the liquid residual amount of the one liquid receiving portion, which is calculated by the residual amount estimation portion, is less than the determination value, the controller performs the maintenance process in which an amount of the liquid discharged through the liquid ejecting head is smaller than that in a case where the liquid residual amount of the one liquid receiving portion, which is calculated by the residual amount estimation portion, is equal to or greater than the determination value.

5. The liquid ejecting apparatus according to claim 1, wherein, when the liquid residual amount of the one liquid receiving portion, which is calculated by the residual amount estimation portion, is less than the determination value, the controller performs the maintenance process in a state where the switching unit is controlled such that the other liquid receiving portion, aside from the one liquid receiving portion, is selected among the liquid receiving portions and the liquid is supplied from the other liquid receiving portion to the liquid ejecting head.

6. The liquid ejecting apparatus according to claim 5, wherein, when the maintenance process including discharging the liquid is finished, the controller controls the switching unit such that the liquid is supplied from the one liquid receiving portion to the liquid ejecting head.

7. The liquid ejecting apparatus according to claim 1, wherein, when each of both the liquid residual amount of the one liquid receiving portion and the liquid residual amount of the other liquid receiving portion, which is calculated by the residual amount estimation portion, is less than the determination value, the controller performs the maintenance process in a state where the switching unit is controlled such that both the one liquid receiving portion and the other liquid receiving portion are communicated with the confluent flow path and the liquid is supplied, to the liquid ejecting head, from both the one liquid receiving portion and the other liquid receiving portion.

8. The liquid ejecting apparatus according to claim 1, wherein the determination value is a value which is set in accordance with a type of the maintenance process to be performed.

9. A liquid ejecting apparatus which includes a liquid ejecting head ejecting liquid, the liquid being supplied from a plurality of liquid receiving portions in which the same kinds of the liquid are received through a confluent flow path, the liquid ejecting apparatus comprising:

a switching unit which switches the liquid receiving portion communicated with the confluent flow path so as to supply the liquid to the liquid ejecting head;

a residual amount estimation portion which separately estimates liquid residual amounts of the respective liquid receiving portions by integrating liquid consumption amounts by the liquid ejecting head; and a controller which performs a maintenance process including discharging the liquid through the liquid ejecting head, wherein, in a case where, among the liquid receiving portions, the liquid receiving portion which supplies the liquid to the liquid ejecting head is set to one liquid receiving portion, when a liquid residual amount of the one liquid receiving portion, which is calculated by the residual amount estimation portion, is less than the determination value, the controller performs the maintenance process in a state where the switching unit is controlled such that the other liquid receiving portion is communicated with the confluent flow path and the liquid is supplied from the other liquid receiving portion to the liquid ejecting head, wherein, when the maintenance process including discharging the liquid is finished, the controller controls the switching unit such that the one liquid receiving portion is communicated with the confluent flow path, and the liquid is ejected on a liquid ejection target in a following printing process while maintaining a state where the one liquid receiving portion is communicated with the confluent flow path and the liquid is supplied from the one liquid receiving portion to the liquid ejecting head.

* * * * *